US005878999A

United States Patent [19]

Neri et al.

[11] Patent Number: 5,878,999

[45] Date of Patent: Mar. 9, 1999

[54] DEVICE FOR FORMING AND TRANSFERRING ORDERED STACKS OF SHEETS, IN PARTICULAR BANKNOTES

[75] Inventors: Armando Neri, Bologna, Italy; James Lacy Vanderpool; Sohail Kayani, both of Irving, Tex.

[73] Assignee: G.D.S.p.A., Bologna, Italy

[21] Appl. No.: 861,812

[22] Filed: May 22, 1997

[30] Foreign Application Priority Data

May 24, 1996 [IT] Italy ..... BO96A0284

[51] Int. Cl.[6] ..... B65G 57/06

[52] U.S. Cl. ..... 270/58.08; 270/58.11; 414/907; 414/790.2

[58] Field of Search ..... 270/58.02, 58.07, 270/58.08, 58.09, 58.13, 58.26, 58.28; 271/215, 220, 221; 414/907, 790, 790.1, 790.2

[56] References Cited

U.S. PATENT DOCUMENTS

| | | | |
|---|---|---|---|
| 3,655,186 | 4/1972 | Bayhga | 414/907 |
| 3,825,134 | 7/1974 | Stobb | 414/907 |
| 3,997,154 | 12/1976 | Mol | 271/215 |
| 4,498,381 | 2/1985 | Convey, Jr. | 414/790.2 |
| 4,509,417 | 4/1985 | Brandt et al. | 414/907 |
| 4,577,853 | 3/1986 | Duke | 271/220 |
| 4,825,378 | 4/1989 | Yuge | 364/478.11 |
| 4,880,350 | 11/1989 | Stobb | 414/790.2 |
| 5,101,979 | 4/1992 | Uno et al. | 414/907 |
| 5,102,292 | 4/1992 | Brinker et al. | 414/907 |
| 5,460,359 | 10/1995 | Toyohara et al. | 414/790.2 |
| 5,460,479 | 10/1995 | Neumann et al. | 414/790.2 |

FOREIGN PATENT DOCUMENTS

| | | |
|---|---|---|
| 0 615 215 A1 | 9/1994 | European Pat. Off. . |
| 2 054 613 | 2/1981 | United Kingdom . |
| 2 138 789 | 10/1984 | United Kingdom . |

*Primary Examiner*—H. Grant Skaggs
*Assistant Examiner*—Patrick Mackey
*Attorney, Agent, or Firm*—Pillsbury Madison & Sutro LLP

[57] ABSTRACT

Banknotes emerging from a checking machine are caused to advance singly in succession along an outfeed duct of which the runout connects with a stacking channel; the banknotes come to rest on a companion element operating along the channel and capable of movement between a first receiving position, in which the banknotes are allowed to accumulate until formed into a group of given number that corresponds to one stack, and a second release position within the operating compass of a compactor with hinged arms, of which the function is to compress and hold the stack against the companion element. The compacted stack of banknotes is picked up finally by a gripper and transferred from the companion element to a bundling machine, which binds it with a wrapping band.

11 Claims, 5 Drawing Sheets

DEVICE FOR FORMING AND TRANSFERRING ORDERED STACKS OF SHEETS, IN PARTICULAR BANKNOTES

BACKGROUND OF THE INVENTION

The present invention relates to a device for forming and transferring ordered stacks of sheets, in particular banknotes.

The present invention is employable to advantage in machines by which banknotes are first ordered and then wrapped in bundles, or in groups of bundles, and, indeed, reference is made herein specifically to this type of application, albeit no limitation in general scope being implied.

The prior art embraces machines for checking the quality or condition of banknotes. In operation, a succession of banknotes of whatever type is introduced into an infeed end of a prior art machine, which, having checked the notes and eliminated any that are found to be defective, divides up the good notes according to denomination and/or type, directing them toward respective outlets of the machine, which are independent one of another.

In this way, groups of respective same denomination or same-type, banknotes are formed at each of the respective outlets; once a predetermined number of banknotes per group has accumulated, the groups are picked-up manually and transferred to a machine by which each of the groups is bound individually with at least one wrapping band to create a respective bundle.

SUMMARY OF THE INVENTION

The object of the present invention is to provide a device for forming and transferring ordered stacks of banknotes by which the connection between the checking machine and the bundling machine can be rendered completely automatic.

The prior art also embraces machines in which the banknotes accumulate at the outlets not as groups of single notes but rather as bundles of notes that have already been checked and secured with wrapping bands.

Accordingly, a further object of the invention is to provide a device such as will bring about the aforementioned automation, handling stacks either of single banknotes or of bundled banknotes with equal ease.

The stated objects are realized according to the present invention with the adoption of a device for forming and transferring ordered stacks of sheets, in particular, banknotes emerging from a checking machine and caused to advance in succession along an outfeed duct. Such a device comprises a companion element, against which the banknotes come to rest one on top of another, operating along a stacking channel and capable of movement at least between a first receiving position in which the banknotes are taken up in a predetermined number constituting a group equivalent to one stack, and a second release position within the operating compass of a compactor element of which the function is to compress the stack of banknotes against the companion element to create a compacted stack of banknotes, also pincer-like gripping means operating at the release position, disposed and embodied in such a way as to pick up the compacted stack of banknotes and transfer it from the companion element to a bundling machine.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENTS

Figure 1:
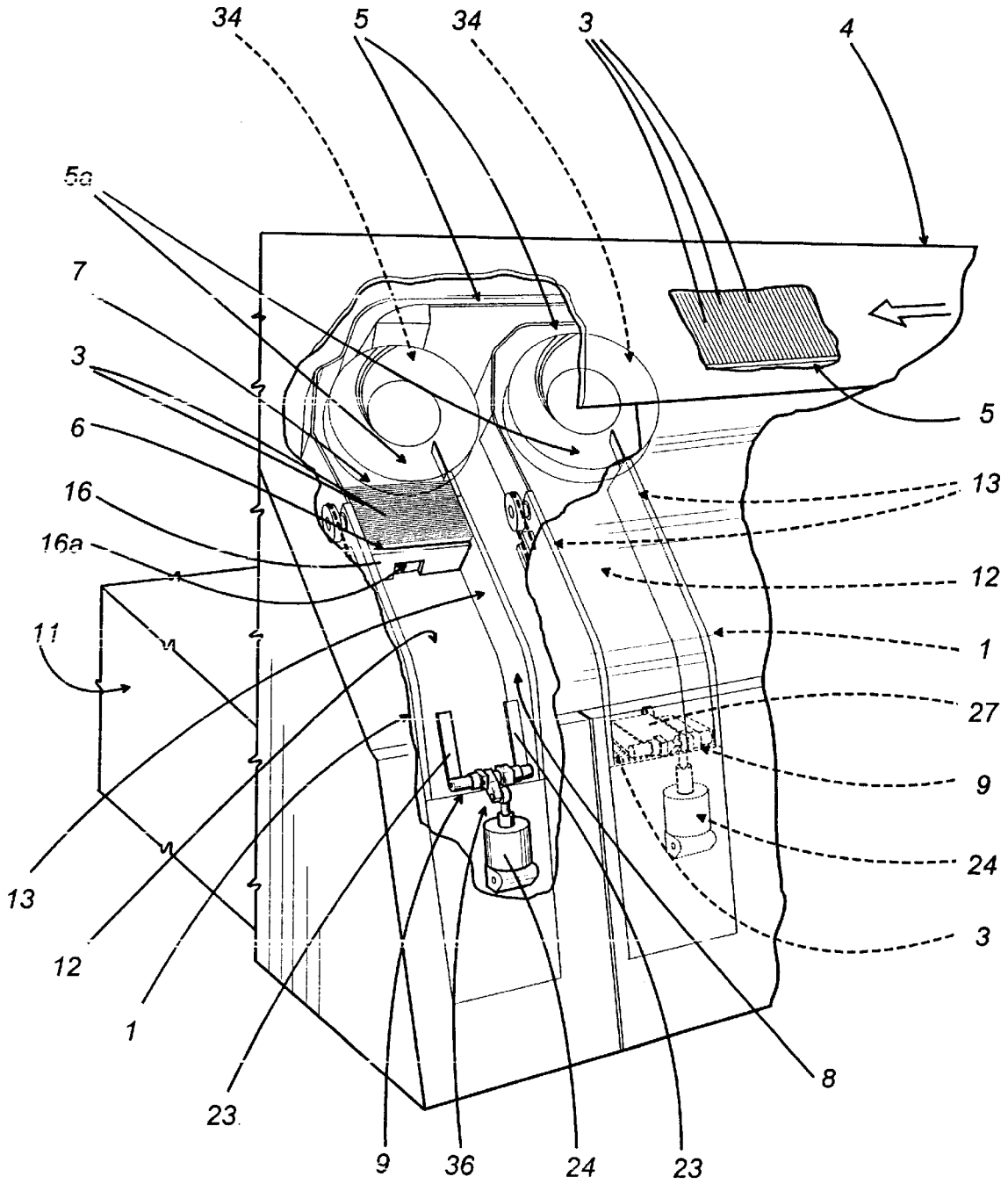
FIG. 1 illustrates a preferred embodiment of the device according to the present invention, viewed in perspective with certain parts in section and certain parts omitted, operating between a banknote checking machine and a bundling machine.
Figure 2:
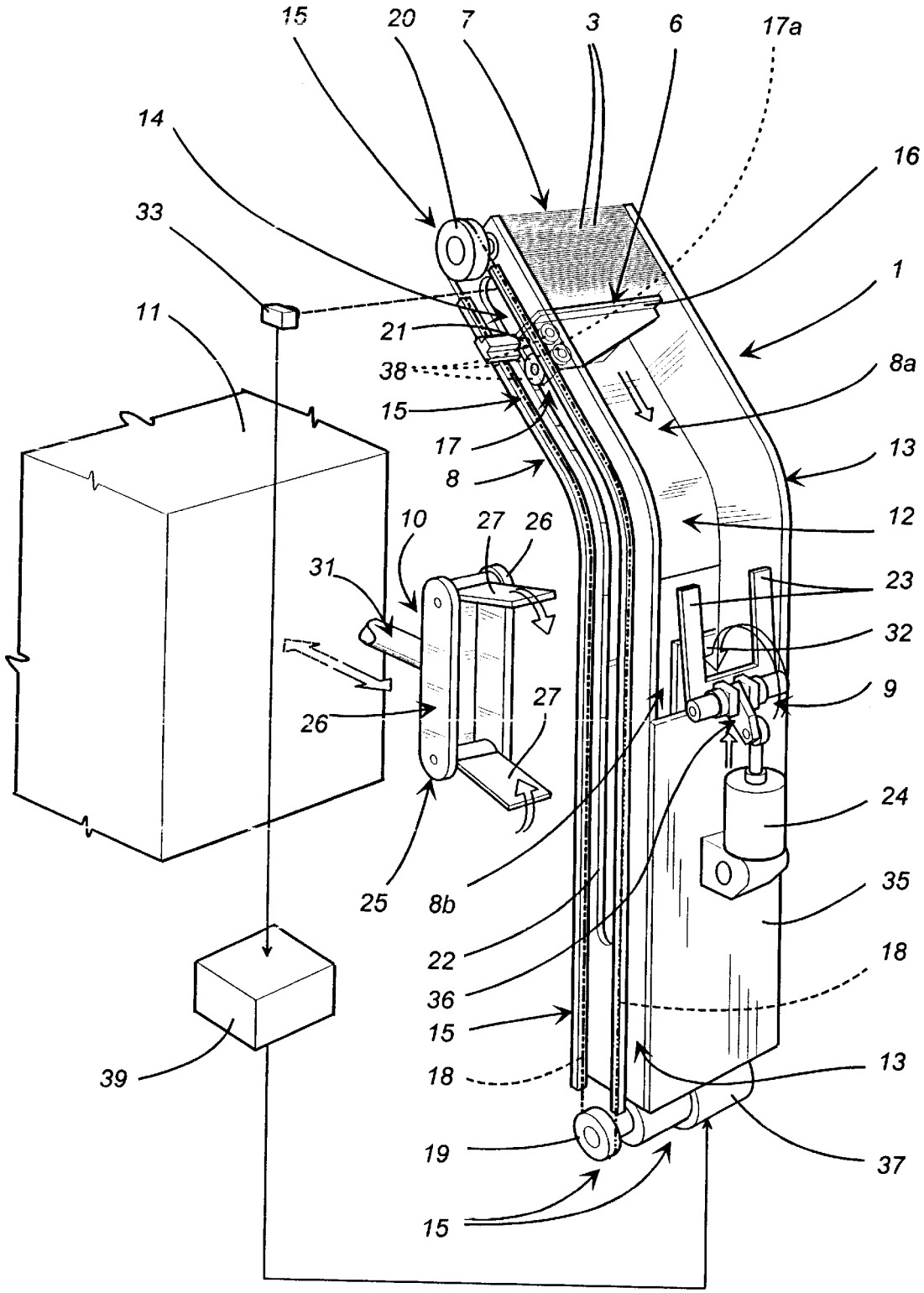
FIG. 2 is a further perspective view of the device illustrated in FIG. 1.

With reference to FIGS. 1 and 2 of the accompanying drawings the numeral, 1 denotes a device, in its entirety, for forming and transferring ordered stacks 2 of single sheets, in particular banknotes 3 emerging from a machine 4 (indicated schematically in FIG. 1, and visible only in part) by which they are checked, and rejected if defective or spoiled. FIG. 1 shows the banknotes 3 advancing along an outfeed duct denoted by the numeral 5; upon reaching the runout 5*a* of the duct 5, the banknotes 3 are taken up by respective gripping means 34 of conventional embodiment and transferred by these same means to the forming and transfer device 1, which in turn forms the sheets first into groups 7 and thereafter into stacks 2 that will be directed on to a bundling machine of conventional embodiment, indicated by the block denoted 11 in the drawings. In practice, the device 1 disclosed is a unit providing an automatic interface between the checking machine 4 (also conventional) and the bundling machine 11.

Throughout the specification, the numeral 7 denotes a group of banknotes 3 already checked by the machine 4, which are caused to accumulate in a stacking channel 8 located beyond the runout 5*a* of the duct 5, whereas the numeral 2 denotes a stack proper, that is to say a group 7 of notes ordered, compacted and ready for bundling. The numeral 7*a* denotes a group of banknotes 3 secured with a wrapping band 28 (as in FIG. 5), which is referred to as a bundle 29.

The stacking channel 8 comprises a back wall 12 and two side walls 13, and constitutes an integral part of the forming and transfer device 1. More exactly, the channel 8 extends transversely and downwards in relation to the duct 5, embodied in two sections connected one to another with no break in continuity and inclined respectively at dissimilar angles relative to the vertical. The top first section, or top ordering section 8*a*, is angled significantly in relation to the vertical, whereas the second bottom section or compacting section 8*b* is substantially upright. The function of the more steeply angled top section 8*a* is to restrain and order the group 7 of banknotes 3 initially during the formation of a stack 2 and to guide the stack 2 subsequently during its transfer to the bottom section 8*b*. The bottom section 8*b* is referred to as a "compacting" section by reason of the fact that the stack 2 of banknotes is subjected to the action of a compactor element 9 associated and operating in conjunction with this same bottom section, as will become evident in due course.

As discernible from FIGS. 1 and 2, the device 1 comprises a companion element 6 which is rendered capable of movement along the stacking channel 8 through the agency of a flexible drive component 18 (such as a chain) looped around two wheels 19, 20 positioned at opposite ends of the channel 8, and routed along one side wall 13 thereof.

The companion element 6 comprises a platform 16, of which the end offered to the internal face of the side wall 13 is furnished with slide means 17 of suitable embodiment consisting, for example, of a trolley 17*a* having wheels 38 that are positioned to roll against the internal face of the side wall 13, following a set path determined by guide means 14 which are incorporated into the side wall 13. More exactly, the trolley 17*a* is connected to the flexible drive component 18 by way of a bracket 21 accommodated slidably within a longitudinal slot 22 provided by the side wall 13 and providing a track along which one wheel 38 of the trolley 17*a* is made to roll.

Figure 3:
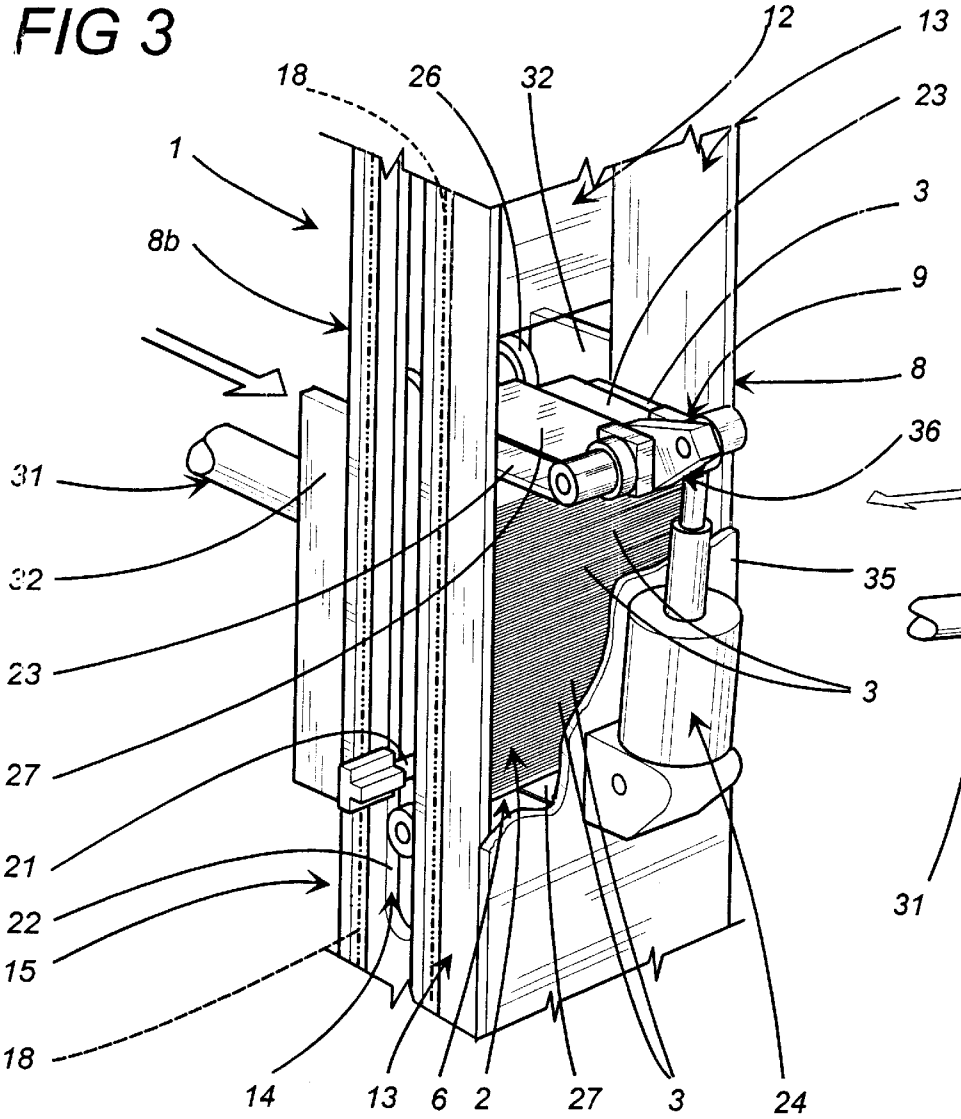
FIG. 3 shows a detail of the device illustrated in FIG. 1, viewed in perspective from the front.

Observing FIGS. 2 and 3, it will be seen that the companion element 6 is capable of movement along the stacking channel 8 between two operating limit positions, namely a first receiving position and a second release position. In the receiving position, the companion element 6 is located at the runout 5*a* of the duct 5 in such a manner as to take up the banknotes 3 as these settle one on top of another on the platform 16, accumulating ultimately until the completion of a selected number corresponding to one group 7 which will go to make up a respective stack 2.

In order to favor the formation of each group 7 of banknotes 3, the companion element 6 could be made, at least when in the first receiving position, to effect a gradual descending movement that will be a function of the number of banknotes 3 allowed to accumulate on the platform 16. In other words, the gradual descending movement would be reflected in a succession of intermediate positions occupied by the companion element 6 during the formation of the group 7, in such a way that the distance between the runout 5*a* of the duct 5 and the last banknote 3 to be added to the group 7 will remain constant. Adopting this type of solution, shown in FIG. 2, the device 1 will be equipped with suitable means 33 by which to sense the passage of the banknotes 3 onto the companion element 6, typically a counter-wired to a monitoring and control unit 39 serving, in turn, to pilot a motor 37 driving one of the wheels 19, or 20 around which the flexible drive component 18 is looped. In practical application, the motor 37 can cause the companion element 6 to descend either by discrete steps or continuously.

In any event, the slide means 17 and flexible drive component 18 together with the wheels 19, 20 and the motor 37 constitute drive means, denoted by the numeral 15 in FIG. 2, by which the companion element 6 is made to alternate between the first receiving position and the second release position.

In the release position, the companion element 6 occupies the bottom section 8*b* of the stacking channel 8. Also operating in this same section 8*b* is a compactor element 9 of which the function is to compress the stack 2 of banknotes 3 against the platform 16 of the companion element 6. Observing FIG. 3 in particular it can be seen that, the compactor element 9 will be seen to comprise a pair of arms 23 associated pivotably with a further wall 35 of the channel 8 and capable thus of movement between a raised or standby limit position, outside the dimensional compass of the stacking channel 8, and a lowered or compacting limit position within the dimensional compass of the channel. The movement in question is produced by an actuator 24 operating a transmission lever 36 to which the two arms 23 are connected. In the raised position, the arms 23 allow the stack 2 of banknotes 3 to pass along the channel 8 during the movement of the companion element 6 toward the second or release operating position. Once the last or topmost banknote 3 of the stack 2 has advanced beyond the arms 23, the arms will be lowered into the compacting limit position and begin thereupon applying pressure to the stack 2, thus packing the accumulated banknotes 3 against the platform 16 of the companion element 6 by which they continue to be supported.

Figure 4:
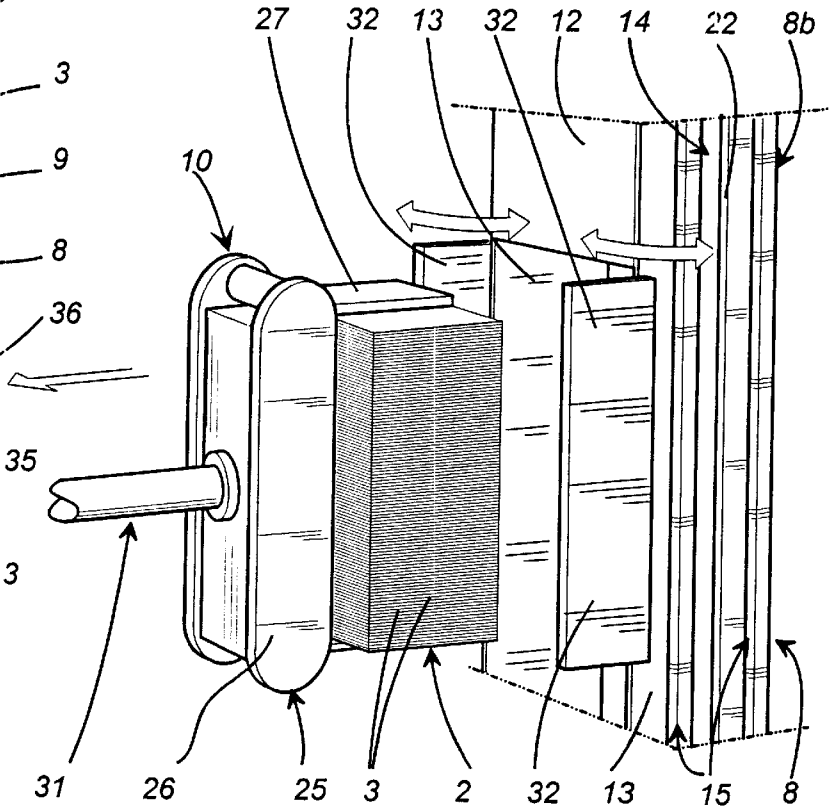
FIG. 4 shows a detail of the device illustrated in FIG. 1, viewed in perspective from the rear.

The device 1 further comprises pincer-like gripping means 10 of which the function is to pick up the stack 2 of banknotes 3 pinned between the arms 23 of the compactor element 9 and the platform 16 of the companion element 6, and transfer it from this position to the bundling machine 11 (as shown to advantage in FIGS. 2 and 4). Such means 10 comprise a gripper 25, furnished with a head 26 of which the face dimensions are substantially the same as those of the stack 2. The head 26, in turn, is furnished bilaterally with a pair of gripping arms 27, top and bottom respectively, between which the stack 2 of banknotes 3 is taken up and held tightly against the head 26; in this way, the stack 2 is compacted further and thus can be distanced from the position occupied hitherto, restrained between the arms 23 of the compactor element 9 and the platform 16 of the companion element 6. The gripper 25 is capable of movement cyclically between an extended position in which the stack 2 is taken up and distanced from the channel 8, and a retracted position in which the stack 2 is released to the bundling machine 11.

In order to allow the cyclical movement whereby the gripper 25 is able to gain the extended position internally of the channel 8 and engage the stack 2, the back wall 12 of the channel provides at least one portion 32 designed to open in the manner of a flap (shown to advantage in FIG. 4), incorporated into the bottom section 8*b* and coinciding with the position occupied by the stack 2 when the companion element 6 is in its second position. To ensure that the arms 27 of the gripper 25 can engage the stack 2 with maximum ease, the platform 16 of the companion element 6 can be fashioned with a recess 16*a* (see FIG. 1) facilitating the entry of the bottom arm 27.

Figure 6:
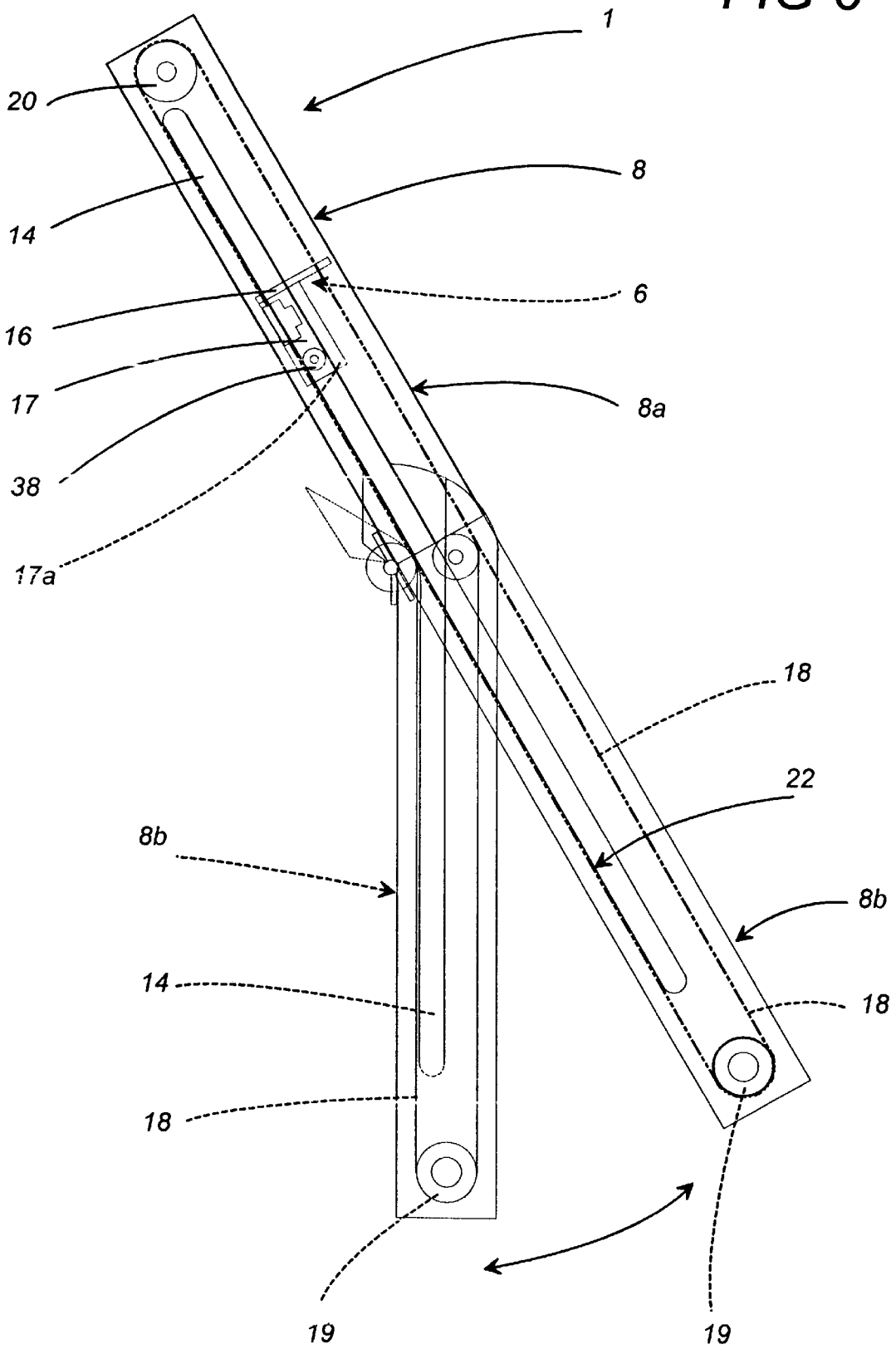
FIG. 6 illustrates a further alternative embodiment of the device according to the present invention, viewed in a schematic side elevation.

FIG. 6 illustrates an embodiment of the device 1 in which the stacking channel 8 is dissimilar to the one in the embodiment which has been; described thus far. In this instance, the channel 8 comprises a bottom section 8*b* hinged to the top section 8*a* and capable thus of movement between a first lowered position, angled in relation to the top section 8*a* and disposed substantially vertical, and a second elevated position substantially of alignment with the top section 8*a*.

Figure 5:
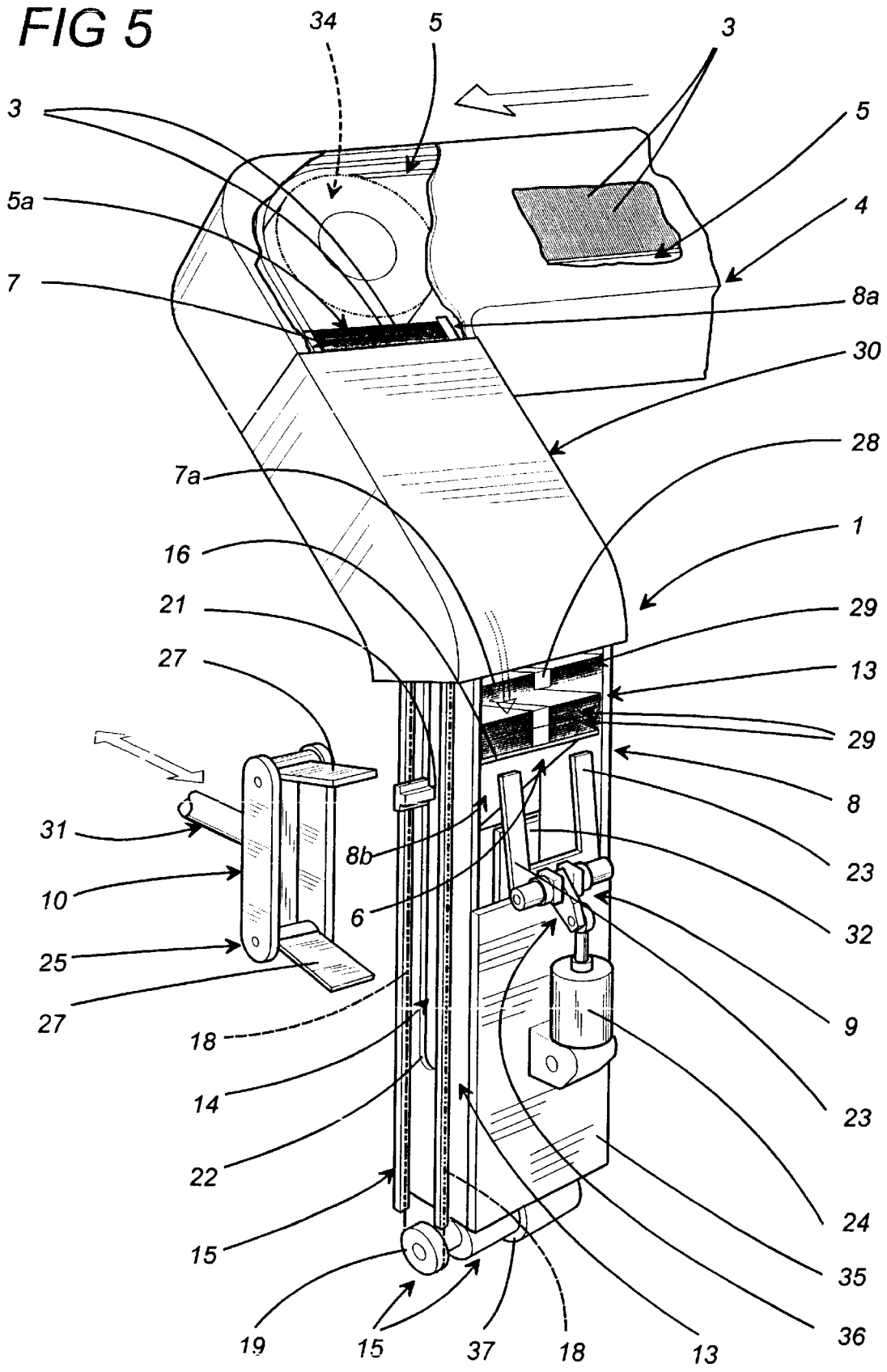
FIG. 5 illustrates an alternative embodiment of the device according to the present invention, viewed in perspective.

In the embodiment of FIG. 5, the device 1 is set up to allow the formation and transfer of groups of banknotes 3 already arranged in ordered stacks 2. Each successive group, denoted 7*a* in FIG. 5 so as to distinguish it from the group 7 accumulating at the runout 5*a* of the duct 5, comprises a predetermined number of banknotes bound together with a wrapping band 28. In this instance, the device 1 will also incorporate a bundling station 30 (conventional in embodiment and illustrated in FIG. 5 as an enclosed unit) associated with the top section 8*a* of the stacking channel 8, which performs the function of dividing up the banknotes 3 into single groups 7*a* and binding each group with a respective wrapping band 28 to create a single bundle 29. In precisely the same manner as described previously for single banknotes 3, the bundles 29 settle one on top of another on the platform 16 of the companion element 6, which is capable of movement at least between two limit operating positions, namely a receiving position coinciding in this instance with the outlet of the top section 8*a* of the channel 8, at which the bundles 29 are received by the bottom section 8*b* and accumulated until the completion of a given number corresponding to one stack 2, and a release position located along the bottom section 8*b* of the channel 8 occupied by the compactor element 9. Clearly, the combined action of the compactor element 9 and the platform 16 of the companion element 6 is applied in this instance to a stack 2 of bundles 29 rather than to a stack of single sheets. The gripper 25 likewise performs the same sequence of operating steps as described previously, taking up the stack 2 of bundles 29 and effecting the transfer from the companion element 6 to the bundling machine 11 (not illustrated), which will then proceed to bind the bundles 29 together.

What is claimed:

1. A device for forming and transferring ordered stacks of sheets which are banknotes emerging from a checking machine and caused to advance in succession along an outfeed duct, comprising:

a compactor element having an operating compass;

a companion element against which the banknotes come to rest, one on top of another, said companion element being arranged for operating along a stacking channel and being capable of movement between two limit operating positions which are respectively a firsts receiving positions in which the banknotes are taken up in a predetermined number constituting a group equivalent to one stack, and a second, release position within said operating compass of said compactor element;

said compactor element being arranged to compress the stack of banknotes against said companion element; and a gripping means arranged for operating at said second limit position, said gripping means being disposed and embodied to compact the stack of banknotes while the stack of banknotes is being restrained by said compactor element and to pick-up the compacted stack of banknotes and transfer the compacted stack of banknotes from said companion element to a bundling machine.

2. The device as in claim 1, wherein:

the outfeed duct has a runout and the stacking channel is located adjacent to the runout of the outfeed duct;

said stacking channel comprising a back wall and two side walls by which the group of banknotes is contained during the formation of the group and during movement of said companion element toward said second operating position;

a drive means arranged for setting said companion element in motion;

at least one said side wall of said stacking channel providing a guide means with and along which said companion element is slidably associated and set in motion by said drive means.

3. The device as in claim 2, wherein:

said stacking channel extends substantially transversely and downwards in relation to said outfeed duct and is embodied in two sections, including a first, top section by which the group of banknotes is ordered and formed into a stack, and a second, bottom section by which the stack is compacted, connected together with no break in continuity and inclined respectively at dissimilar angles relative to vertical.

4. The device as in claim 2, wherein:

said companion element includes a platform disposed transversely to and internally of said stacking channel and supported by slide means supported in turn by and slidable along said guide means.

5. The device as in claim 4 wherein:

said drive means comprise a flexible drive component routed externally along a said side wall of said stacking channel and looped around corresponding wheels, of which one is power driven, said flexible drive component being connected to said slide means of said companion element by bracket means arranged for movement along a longitudinal slot provided by said at least one side wall.

6. The device as in claim 1, further comprising:

an actuator;

said compactor element comprising a pair of arms pivotably associated with said stacking channel and being capable of movement, generated by said actuator, between a raised standby limit position outside said stacking channel, in which freedom of passage is allowed to the stack of banknotes during downward movement of said companion element toward said second operating position, and a lowered compacting limit position within said stacking channel, in which compacting pressure is applied to the stack of banknotes.

7. The device as in claim 1 wherein:

said gripping means comprise a gripper including a head having face dimensions which are substantially the same as face dimensions of the stack of banknotes, and a pair of gripping arms extending bilaterally from the head, top and bottom respectively, by which the stack of banknotes pinned between said compactor element and said companion element can be taken-up, compacted further and displaced from a current position due to the gripper being capable of movement cyclically between an extended position, in which the stack of banknotes is picked up and distanced from the stacking channel, and a retracted position in which the stack of banknotes is released to a bundling machine.

8. The device as in claim 7, wherein:

said back wall of said stacking channel provides at least one portion which is positioned so as to be level with said gripping means and which is designed so as to open in such a manner that said gripping means can move toward said extended position and pick up the stack of banknotes.

9. The device as in claim 2, wherein:

said companion element is arranged, at least when in said first receiving position, to effect a gradual descending movement that is a function of the number of banknotes accumulated in order to complete one group;

said companion element further comprising means for monitoring accumulation of banknotes on said companion element, and to pilot operation of said drive means accordingly.

10. The device as in claim 3, wherein:

said second, bottom section of said stacking channel is hinged to said first, top section and thereby is capable of movement between a first, lowered position, angled in relation to said first, top section, and a second, elevated position wherein said second bottom section is substantially in alignment with said first, top section.

11. A device as in claim 3, wherein:

said first, top section of said stacking channel incorporates a bundling station along which the group of banknotes is divided up into single smaller groups, each bound individually with a respective wrapping band to form a single bundle and brought to rest thereafter on said companion element.

* * * * *